US006494329B1

(12) United States Patent
Dembicks

(10) Patent No.: US 6,494,329 B1
(45) Date of Patent: Dec. 17, 2002

(54) SOCKET HOLDER WITH RELEASABLE CLIPS

(75) Inventor: Tyler J. Dembicks, Raleigh, NC (US)

(73) Assignee: Andrews Toolworks, Inc., Raleigh, NC (US)

( * ) Notice: Subject to any disclaimer, the term of this patent is extended or adjusted under 35 U.S.C. 154(b) by 0 days.

(21) Appl. No.: 09/950,174

(22) Filed: Sep. 10, 2001

(51) Int. Cl.[7] ..... A47F 7/00
(52) U.S. Cl. ..... 211/70.6; 206/378
(58) Field of Search ..... 211/70.6, 89.01, 211/94.01; 206/378

(56) References Cited

U.S. PATENT DOCUMENTS 3,904,034 A 9/1975 Saunders
4,353,465 A 10/1982 Rado
4,717,106 A * 1/1988 Bies et al. ..... 211/70.6 X
4,826,021 A * 5/1989 Burrell ..... 211/70.6
4,987,998 A 1/1991 Tsai
5,284,245 A 2/1994 Slivon et al.
5,368,164 A * 11/1994 Bennett et al.
5,573,116 A 11/1996 Zink
5,740,911 A * 4/1998 Chou ..... 206/378
5,848,694 A 12/1998 Newton
5,862,913 A * 1/1999 Chou ..... 206/378
5,897,001 A * 4/1999 Dembicks ..... 211/70.6
5,975,297 A * 11/1999 Kao ..... 206/378
6,070,745 A 6/2000 Dembicks
6,092,655 A * 7/2000 Ernst ..... 206/378
6,145,662 A * 11/2000 Newton ..... 211/70.6 X
6,168,018 B1 * 1/2001 Ramsey et al. ..... 206/378
6,386,363 B1 * 5/2002 Huang ..... 206/378

* cited by examiner

*Primary Examiner*—Robert W. Gibson, Jr.
(74) *Attorney, Agent, or Firm*—Akerman Senterfitt

(57) ABSTRACT

A system for securing at least one socket includes a base member and at least one clip sized to engage the socket. The clip can have a top surface, at least one leg extending from the top surface for detachably mounting the clip to the base member, and at least one releasing structure extending from the top surface. The releasing structure can have a release tab for disengaging the socket from the clip.

14 Claims, 3 Drawing Sheets

SOCKET HOLDER WITH RELEASABLE CLIPS

BACKGROUND OF THE INVENTION

1. Field of the Invention

The present invention relates generally to a tool-holding device and, more particularly, to an apparatus for holding sockets.

2. Description of the Related Art

Wrenches having a head with a square or rectangular ratcheting shaft are well known and are commonly used in various home, shop and office environments. Shafts for such wrenches are typically available in various sizes of the English and metric measurement systems. Interchangeable sockets can be mounted to the shaft for loosening or tightening bolts and other threaded fasteners. The sockets are often designed in sets so that multiple sockets have the same sized square shaft opening with hexagonal openings for receiving bolts heads that vary in size, such as in increments of one-sixteenth of an inch.

As sockets come in many different sizes, they can be difficult to organize and maintain so that a particular sized socket can be easily located when needed. Such organization can be particularly difficult when sockets are stored in a portable tool tray or chest in which the order of the sockets can be easily disturbed, or when a user carries more than one set of sockets for various English or metric unit wrenches.

To overcome these problems, socket wrench cases have been developed with incrementally sized recesses for holding the sockets. Typically, however, the sockets will be tossed out of their corresponding recesses and scattered throughout the case if the case is tipped over or jolted, even if the case is covered.

One solution to this problem is the use of socket holders having one or more spring clips. For example, as shown in U.S. Pat. No. 5,848,694 to Newton, a spring clip secured to a mounting rail can be used to engage a socket by forcing the ratchet shaft opening of the socket onto the spring clip. Although the spring clips in Newton can hold sockets in place, it can be difficult for a user to remove the sockets from the clips. Thus, a need exists in the art for a socket holder in which the sockets can be securely retained for storage but easily released when desired.

SUMMARY OF THE INVENTION

The invention features a system for securing at least one socket. In one arrangement, the system include a base member and at least one clip sized to engage the socket. The clip has a top surface. The system further includes at least one leg extending from the top surface for detachably mounting the clip to the base member, and at least one releasing structure extending from the top surface. The releasing structure has a release tab for disengaging the socket from the clip.

In another arrangement of the invention, the system includes at least one clip sized to engage the socket. The clip has a top surface. The system further includes at least one leg extending from the top surface for detachably mounting the clip to the base member, and at least one releasing structure extending from the top surface. The releasing structure has a release tab for disengaging the socket from the clip.

The releasing structure can have a protruding section, in which the protruding section is positioned against an inner surface of the socket when the clip engages the socket. The release tab can cause the protruding section to move away from the inner surface of the socket when the release tab is compressed. The release tab can extend outward from the base member. In addition, the release tab can have a rounded end.

The clip can have a first side and a second side opposing the first side. Further, the first and second sides each can have at least one releasing structure, at least one leg, or a combination thereof. The clip can slidably engage the base member.

The base member can be an elongated rail having parallel tracks. Further, at least one end of the elongated rail can contain at least one aperture for securing the rail to a surface.

DETAILED DESCRIPTION OF THE PREFERRED EMBODIMENTS

Figure 3:
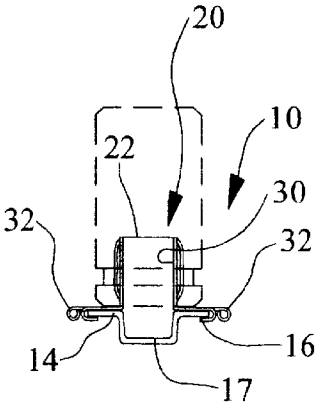
FIG. 3 is an end view of the socket holder system of FIG. 1.
Figure 1:
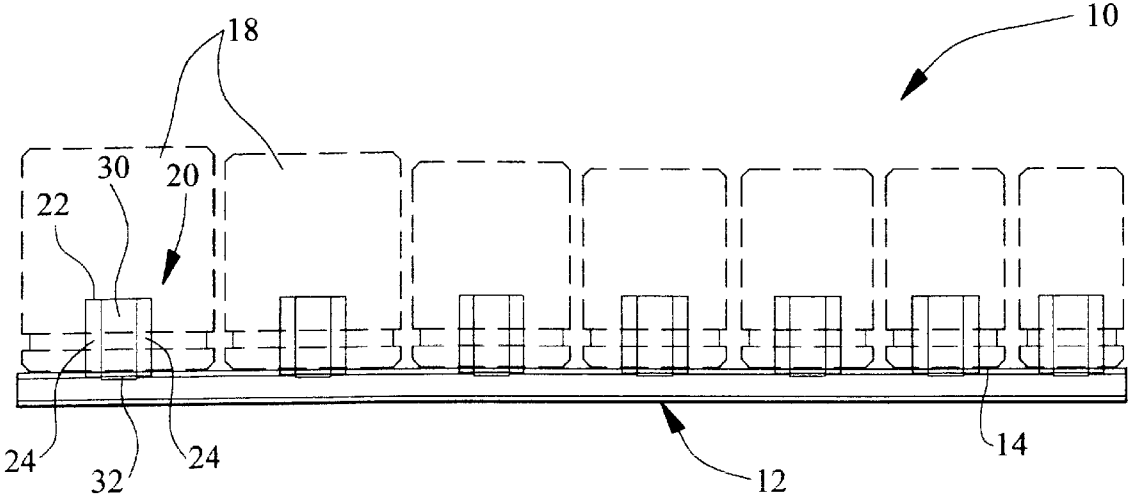
FIG. 1 is a side view of a socket holder system according to the invention having incrementally sized sockets mounted onto clips.
Figure 2:
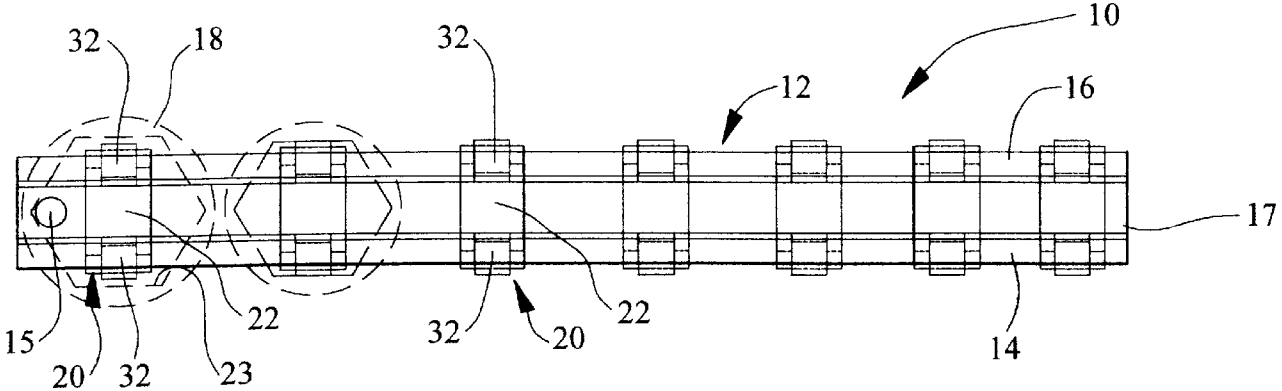
FIG. 2 is a top view of a socket holder according to the invention.

Referring to FIGS. 1–3, there is shown a system 10 for securing one or more socket holders 10 according to the present invention. The system 10 includes an elongated mounting rail 12 and at least one clip 20. The elongated mounting rail 12 can include a pair of tracks 14, 16 for receiving the clip 20. The tracks 14, 16 can be parallel, although the invention is not limited in that regard. The tracks 14, 16 can be separated by a recessed valley bounded at the bottom by a base 17. The mounting rail 12 can be constructed of any material suitable for supporting the weight of one or more sockets 18, such as metal or plastic.

As shown in FIG. 2, an aperture 15 can be located at one end of the mounting rail 12. A screw, nail, rivet or any other similar fastener can be disposed through the aperture 15 to secure the mounting rail 12 to a surface such as a wall, the bottom of a tool tray or a tool chest drawer. In another arrangement, the mounting rail 12 can be attached to a handle for portable use. In either arrangement, the base 17 can be recessed so that the tracks 14, 16 will not contact the surface to which the mounting rail 12 is secured. Although FIG. 2 shows only one aperture 15, it should be noted that the invention is not so limited, as any number of apertures 15 can be located at any point on the mounting rail 12.

Figure 4B:
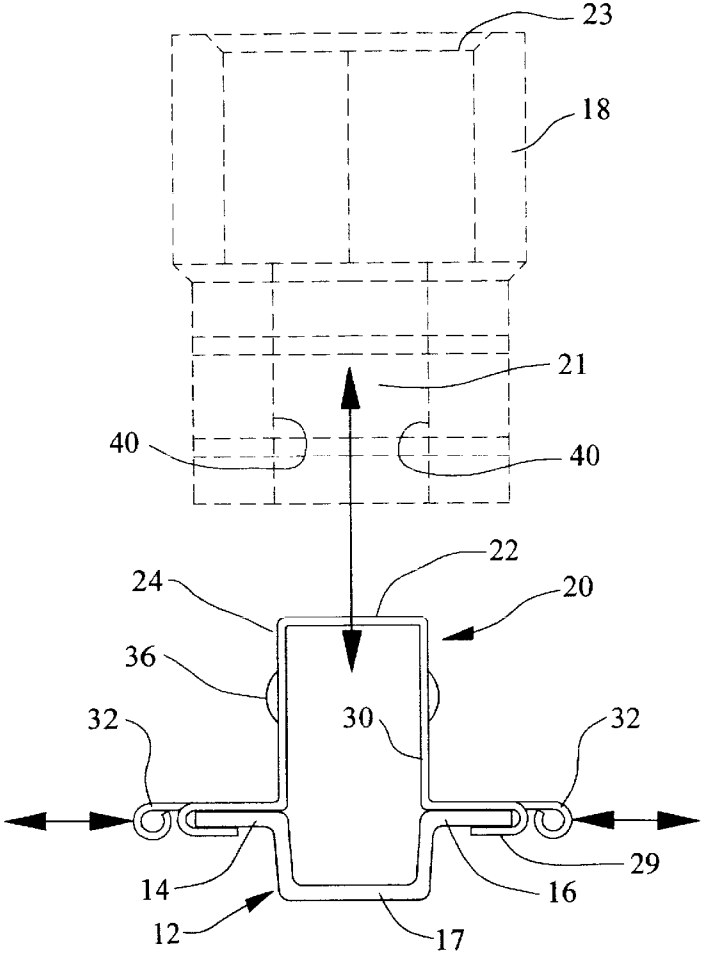
FIG. 4B shows an end view of an alternative socket holder system as a socket is being positioned to be placed over a clip.
Figure 4A:
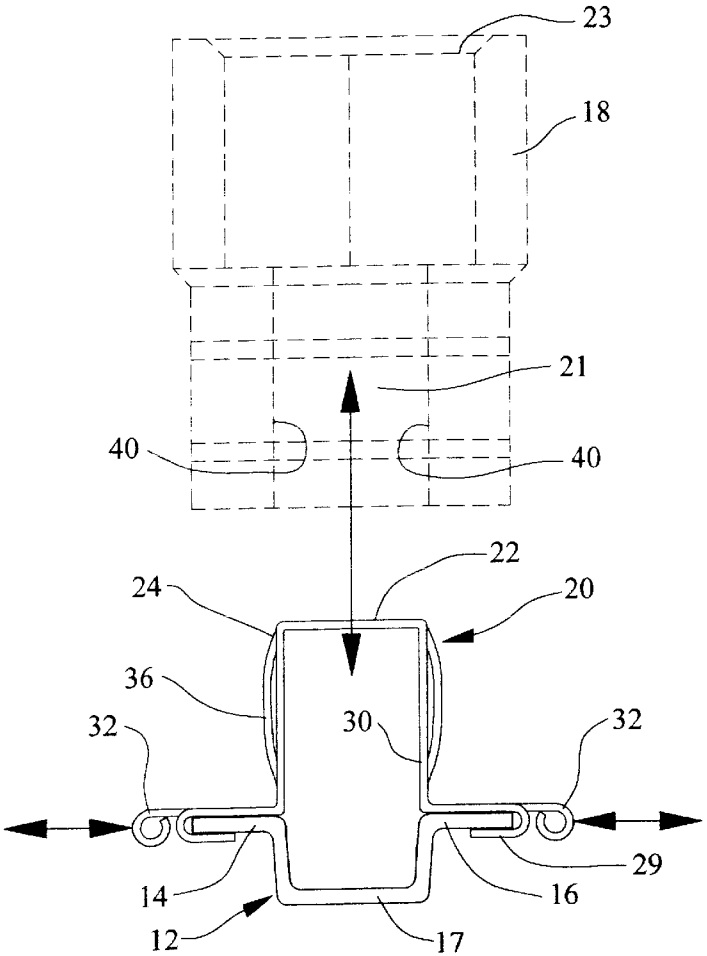
FIG. 4A shows an end view of the socket holder system of FIG. 1 as a socket is being positioned to be placed over a clip.

One or more sockets 18 can be mounted to the mounting rail 12 by engaging the socket 18 with an appropriately sized clip 20. The clips 20 can be constructed to receive sockets 18 of any dimension. Although FIGS. 1 and 2 show seven clips mounted to the mounting rail 12, it is understood that the mounting rail 12 can accommodate any number of clips 20. Referring to FIGS. 2 and 4, each socket 18 can contain a bolt opening 23 for receiving an appropriately sized bolt head. Although FIG. 2 illustrates the socket 18 as having a hexagonal bolt opening 23, it is understood that the clip 20 can receive sockets 18 that contain bolt openings 23 of any other shape suitable for engaging bolt heads. Referring to FIGS. 4A and 4B, each socket 18 can include a ratchet opening 21 for receiving an appropriately sized ratchet. The ratchet opening 21 is generally located opposite of the bolt opening 23. Typically, rachet opening 21 is square-shaped; however, the ratchet opening 21 can be in the form of any other shape suitable for receiving a ratchet.

Each clip 20 can have a top surface 22 sized slightly smaller than the ratchet opening 21. In one arrangement, the top surface 22 is square and can be made to fit any standard English or metric socket 18. It should be noted, however, that the shape of the top surface 22 is not limited in this regard as the top surface 22 can be shaped to receive sockets 18 that have ratchet openings 21 of any shape. In another arrangement, each clip 20 on the mounting rail 12 holds those sockets 18 associated with a particular ratchet wrench. For example, each clip 20 on the mounting rail 12 can be sized to engage the sockets 18 that contain a one-half inch ratchet opening 21. It is understood, however, that the clips 20 can be sized to hold the sockets 18 for a variety of ratchet wrench sizes and are not limited to any particular ratchet wrench size.

Referring to FIGS. 1, 3, 4A, 4B and 5, each clip 20 can have at least one leg 24 extending from the top surface 22. The leg 24 is used to mount the clip 20 onto the mounting rail 12. In one arrangement, the leg 24 is L-shaped and contains a rounded end 29. The rounded end 29 can be used to engage either of the tracks, 14, 16. Additionally, the ends of the tracks 14, 16 can be rounded so as to facilitate feeding the clip 20 onto the mounting rail 12, although the invention is not limited in that regard. The rounded end 29 allows the clip 20 to engage the mounting rail 12 and permits the clip 20 to slide along the mounting rail 12. As a result, the clips 20 can be positioned anywhere along the length of the mounting rail 12 to provide suitable spacing to grasp the sockets 18 and to accommodate different sized sockets 18.

In one arrangement, at least one clip 20 has two pairs of opposing legs 24, in which one pair of legs 24 engages track 14 and the other pair engages track 16. It is understood, however, that the invention is not limited in this regard, as the clip 20 can contain any suitable number of legs 24.

To enable the clip 20 to disengage the socket 18, each clip 20 can contain at least one releasing structure 30. As shown in FIGS. 1–5, the releasing structure 30 can extend from the top surface 22 and can be disposed between each pair of legs 24. It should be noted, however, that the invention is not limited to the arrangement illustrated in the drawings, as the clip 20 can contain one or more releasing structures 30 which can extend from the top surface 22 at other locations.

Figure 5:
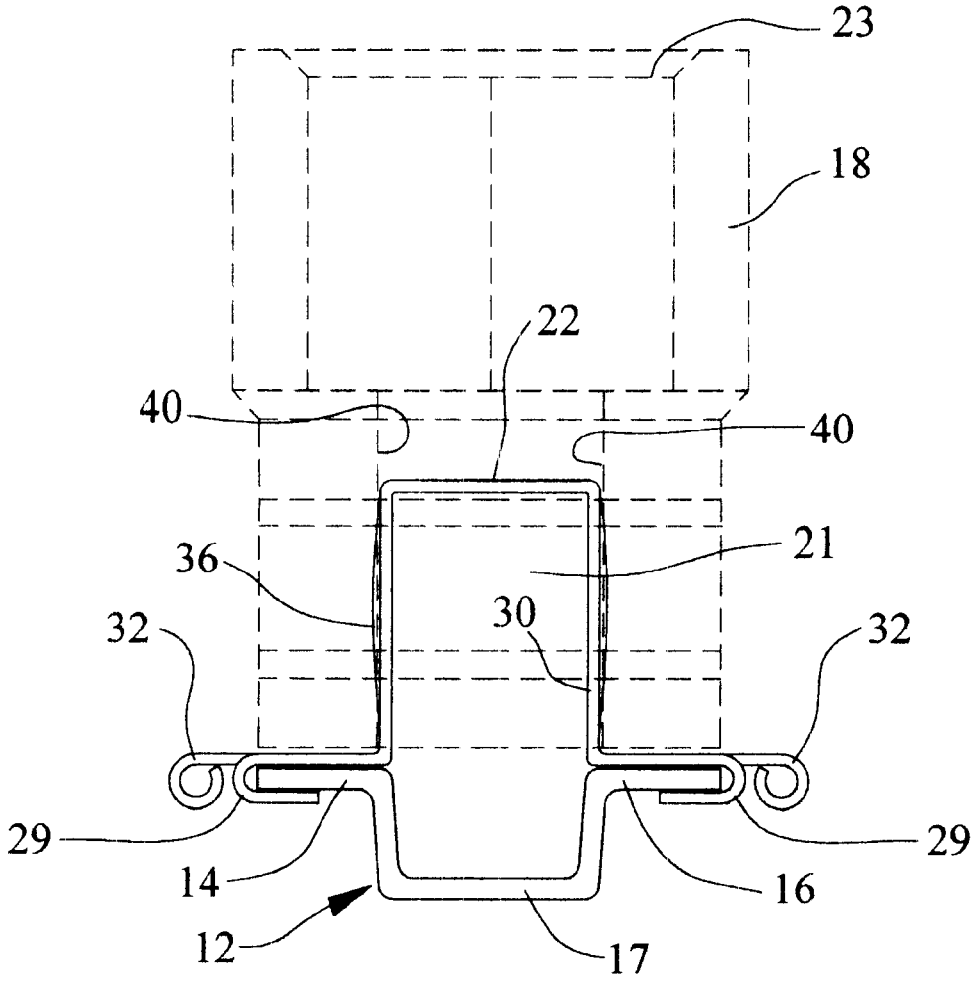
FIG. 5 shows a socket being secured to the clip of FIG. 4A.

The releasing structure 30 can contain a release tab 32 and a protruding section 36. As shown in FIG. 5, the release tab 32 can extend outwardly away from the mounting rail 12. When the clip 20 engages the socket 18, the release tab 32 can be disposed between the socket 18 and one of the tracks 14, 16. The release tab 32 can extend slightly beyond the socket 18 thereby providing the user access to the release tab 32. In addition, the release tab 32 can contain a rounded end which can reduce the discomfort a user may feel when squeezing the release tab 32 to disengage the socket 18. It is understood, however, that the release tab 32 is not limited to the particular configuration illustrated in FIG. 5, as the release tab 32 can extend a greater distance away from the mounting rail 12, and the size of the rounded ends can be increased thereby increasing user comfort.

As shown in FIGS. 4A and 4B, the protruding section 36 can be a section of the releasing structure 30 that projects slightly outward from the section of the releasing structure 30 that comes into contact with the interior of the socket 18. Referring to FIG. 4B, in one particular arrangement, the protruding section 36 can be a tab. It should be noted, however, that the protruding section 36 is not limited to this particular configuration, as the protruding section 36 can be any suitable structure that projects slightly outward from the releasing structure. As discussed below, the protruding section 36 enables the clip 20 to securely engage the socket 18.

Referring to FIGS. 4A and 4B, a socket 18 can be mounted to the clip 20 by orienting the socket 18 so that the ratchet opening 21 fits over the top surface 22 and by forcing the socket 18 down over the clip 20, as shown by the vertical arrow. It should be noted that the socket 18 can be mounted to the clip 20 before or after the clip 20 is mounted to the mounting rail 12. As the socket 18 is pressed down, opposite inner walls 40 defining the ratchet opening 21 can contact the protruding section 36 and can depress the releasing structure 30 inwardly. The protruding section 36 of the releasing structure 30 can thereby be securely positioned against the inner walls 40 so as to secure the socket 18 to the clip 20, as shown in FIG. 5.

To remove the socket 18 from the clip 20, the release tab 32 can be inwardly depressed. This can cause the releasing structure 30 to move laterally inward (as shown by the arrows of FIGS. 4A and 4B) which can cause the protruding section 36 to disengage the inner walls 40 so that the socket 18 can be freely pulled away from the clip 20. Additionally, the releasing structure 30 can return to its original position once the socket 18 is removed. It should be noted that the releasing structure 30 can be sufficiently flexible so that the socket 18 can be removed from the clip 20 by pulling the socket 18 away from the clip 20 without first depressing the release tab 32.

The present invention has been shown and described herein in what is considered to be the most practical and preferred embodiments. It is recognized, however, that departures may be made therefrom within the scope of the invention and that obvious modifications will occur to a person skilled in the art. Accordingly, reference must be had to the following claims in order to determine the full scope of the invention.

What is claimed is:

1. A system for securing at least one socket, comprising:

a base member;

at least one clip sized to engage the socket;

wherein said clip has a top surface, at least one leg extending from said top surface for detachably mounting said clip to said base member, and at least one releasing structure extending from said top surface;

wherein said releasing structure has a release tab for disengaging the socket from said clip and a protruding section;

wherein said release tab causes said protruding section to move away from said inner surface of the socket when said release tab is compressed; and wherein said protruding section is positioned against an inner surface of the socket when said clip engages the socket.

2. The system according to claim 1, wherein said release tab extends outward from said base member.

3. The system according to claim 1, wherein said release tab has a rounded end.

4. The system according to claim 1, wherein said clip has a first side and a second side opposing said first side, and wherein said first and second sides each have at least one said releasing structure.

5. The system according to claim 1, wherein said clip has a first side and a second side opposing said first side, and wherein said first and second sides each have at least one said leg.

6. The system according to claim 1, wherein said clip has a first side and a second side opposing said first side, and wherein said first and second sides each have at least one said releasing structure and at least one said leg.

7. The system according to claim 1, wherein said clip slidably engages said base member.

8. The system according to claim 1, wherein said base member is an elongated rail having parallel tracks.

9. The system according to claim 8, wherein at least one end of said elongated rail contains at least one aperture for securing said rail to a surface.

10. A system for securing at least one socket, comprising:

at least one clip sized to engage the socket;

wherein said clip has a top surface, at least one leg extending from said top surface, and at least one releasing structure extending from said top surface;

wherein said releasing structure has a release tab for disengaging the socket from said clip, and a protruding section;

wherein said release tab causes said protruding section to move away from said inner surface of the socket when said release tab is compressed; and wherein said protruding section is positioned against an inner surface of the socket when said clip engages the socket.

11. The system according to claim 10, wherein said release tab has a rounded end.

12. The system according to claim 10, wherein said clip has a first side and a second side opposing said first side, and wherein said first and second sides each have at least one said releasing structure.

13. The system according to claim 10, wherein said clip has a first side and a second side opposing said first side, and wherein said first and second sides each have at least one said leg.

14. The system according to claim 10, wherein said clip has a first side and a second side, opposing said first side, and wherein said first and second sides each have at least one said releasing structure and at least one said leg.

* * * * *